US011339759B2

(12) United States Patent
Assaf et al.

(10) Patent No.: US 11,339,759 B2
(45) Date of Patent: May 24, 2022

(54) ENGINE TORQUE ESTIMATION AND CONTROL SYSTEMS AND METHODS

(71) Applicant: GM GLOBAL TECHNOLOGY OPERATIONS LLC, Detroit, MI (US)

(72) Inventors: Tameem K. Assaf, Troy, MI (US); Kristopher J. Healey, Huntington Woods, MI (US); Chao F. Daniels, Superior Township, MI (US); Shanshan L. Peer, Ann Arbor, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 17/066,792

(22) Filed: Oct. 9, 2020

(65) Prior Publication Data

US 2022/0112872 A1 Apr. 14, 2022

(51) Int. Cl.

| | |
|---|---|
| ***F02P 5/153*** | (2006.01) |
| ***F02D 41/30*** | (2006.01) |
| ***F02P 5/14*** | (2006.01) |
| ***F02P 5/06*** | (2006.01) |

(52) U.S. Cl.

CPC ..... *F02P 5/153* (2013.01); *F02D 41/30* (2013.01); *F02P 5/06* (2013.01); *F02P 5/142* (2013.01); *F02D 2200/101* (2013.01)

(58) Field of Classification Search

CPC .... F02P 5/153; F02P 5/06; F02P 5/142; F02D 41/30; F02D 2200/101

USPC ..... 123/406.47

See application file for complete search history.

(56) References Cited

U.S. PATENT DOCUMENTS 5,044,195 A * 9/1991 James ..... F02D 41/1497 73/114.05
5,109,695 A * 5/1992 James ..... G01M 15/11 73/114.05
6,415,656 B1 * 7/2002 Bidner ..... F02D 41/22 73/114.11

(Continued)

FOREIGN PATENT DOCUMENTS

JP 07063149 A * 3/1995
JP 2002221068 A * 8/2002
JP 2002332897 A * 11/2002

OTHER PUBLICATIONS

"The Lasso" PennState Eberly College of Science. STAT 508 Applied Data Mining and Statistical Learning: 5.4—The Lasso: https://online.stat.psu.edu/stat508/book/export/html/749. Printed Jan. 17, 2020.

(Continued)

*Primary Examiner* — Mahmoud Gimie

(57) ABSTRACT

An engine control system includes: a normalization module configured to normalize, to within a predetermined range of values, a spark timing of an engine and at least one other parameter of the engine, thereby producing a normalized spark timing and at least one normalized other parameter, respectively; a processing module configured to generate a sigmoidal spark timing by applying, to the normalized spark timing, one of (a) a sigmoidal function and a sinusoidal function; and an estimation module configured to estimate a torque output of the engine based on the normalized spark timing and the at least one normalized other parameter using a mathematical model.

20 Claims, 4 Drawing Sheets

(56) References Cited

U.S. PATENT DOCUMENTS

| | | | | |
|---|---|---|---|---|
| 7,085,631 | B2 * | 8/2006 | McGee | B60W 20/00 701/22 |
| 9,702,115 | B1 * | 7/2017 | Darukhanavala | E02F 9/26 |
| 2008/0066718 | A1 * | 3/2008 | Sato | F02D 9/02 123/350 |
| 2015/0275789 | A1 * | 10/2015 | Cygan, Jr. | B60W 10/06 701/102 |
| 2017/0241369 | A1 * | 8/2017 | Jammoussi | F02D 41/0002 |

OTHER PUBLICATIONS

Adewumi, Michael. "Solution Techniques for Cubic Expressions and Root Finding", PennState College of Earth and Minieral Sciences. PNG 520 Phse Relations in Reservoir Engineering. The Pennsylvania State University, 2018. Solution Techniques for Cubic Expressions and Root Finding | PNG 520: Phase Behavior of Natural Gas and Condensate Fluids (psu.edu) Printed Jan. 17, 2020.

* cited by examiner

ENGINE TORQUE ESTIMATION AND CONTROL SYSTEMS AND METHODS

INTRODUCTION

The information provided in this section is for the purpose of generally presenting the context of the disclosure. Work of the presently named inventors, to the extent it is described in this section, as well as aspects of the description that may not otherwise qualify as prior art at the time of filing, are neither expressly nor impliedly admitted as prior art against the present disclosure.

The present disclosure relates to internal combustion engines and more particularly to engine control systems and methods for vehicles.

Internal combustion engines combust an air and fuel mixture within cylinders to drive pistons, which produces drive torque. Air flow into the engine is regulated via a throttle. More specifically, the throttle adjusts throttle area, which increases or decreases air flow into the engine. As the throttle area increases, the air flow into the engine increases. A fuel control system adjusts the rate that fuel is injected to provide a desired air/fuel mixture to the cylinders and/or to achieve a desired torque output. Increasing the amount of air and fuel provided to the cylinders increases the torque output of the engine.

In spark-ignition engines, spark initiates combustion of an air/fuel mixture provided to the cylinders. In compression-ignition engines, compression in the cylinders combusts the air/fuel mixture provided to the cylinders. Spark timing and air flow may be the primary mechanisms for adjusting the torque output of spark-ignition engines, while fuel flow may be the primary mechanism for adjusting the torque output of compression-ignition engines.

SUMMARY

In a feature, an engine control system includes: a normalization module configured to normalize, to within a predetermined range of values, a spark timing of an engine and at least one other parameter of the engine, thereby producing a normalized spark timing and at least one normalized other parameter, respectively; a processing module configured to generate a sigmoidal spark timing by applying, to the normalized spark timing, one of (a) a sigmoidal function and a sinusoidal function; and an estimation module configured to estimate a torque output of the engine based on the normalized spark timing and the at least one normalized other parameter using a mathematical model.

In further features, an actuator module is configured to adjust an engine actuator based on the estimated torque output of the engine.

In further features, the at least one other parameter of the engine includes an engine speed.

In further features, the at least one other parameter of the engine includes a mass of air per cylinder (APC) of the engine.

In further features, the at least one other parameter of the engine includes an intake cam phaser angle.

In further features, the at least one other parameter of the engine includes an exhaust cam phaser angle.

In further features, the at least one other parameter of the engine includes an equivalence ratio (EQR) of the engine.

In further features, the at least one other parameter of the engine includes a maximum braking torque (MBT) spark timing of the engine.

In further features, the at least one other parameter of the engine includes: an engine speed; a mass of air per cylinder (APC) of the engine; an intake cam phaser angle; an exhaust cam phaser angle; an equivalence ratio (EQR) of the engine; and a maximum braking torque (MBT) spark timing of the engine.

In further features, the sigmoid function includes a logistic function.

In further features, the at least one other parameter of the engine includes a timing of a start of fuel injection of the engine.

In further features, the at least one other parameter of the engine includes a timing of an end of fuel injection of the engine.

In further features, the processing module is further configured to generate an exponential engine speed by applying an exponential function to an engine speed, and the estimation module configured to estimate the torque output of the engine further based on the exponential engine speed using the mathematical model.

In further features, the processing module is further configured to generate an exponential of negative engine speed by applying an exponential function to a negative engine speed, and the estimation module configured to estimate the torque output of the engine further based on the exponential of negative engine speed using the mathematical model.

In further features, the processing module is further configured to generate an exponential maximum braking torque (MBT) spark timing by applying an exponential function to an MBT spark timing of the engine, and the estimation module configured to estimate the torque output of the engine further based on the exponential MBT spark timing using the mathematical model.

In further features, the processing module is further configured to generate an exponential of negative maximum braking torque (MBT) spark timing by applying an exponential function to a negative MBT spark timing of the engine, and the estimation module configured to estimate the torque output of the engine further based on the exponential of negative MBT spark timing using the mathematical model.

In a feature, an engine control system includes: a normalization module configured to normalize, to within a predetermined range of values, a maximum braking torque (MBT) spark timing of an engine and at least one other parameter of the engine, thereby producing a normalized MBT spark timing and at least one normalized other parameter, respectively; and an estimation module configured to estimate a torque output of the engine based on the normalized MBT spark timing and the at least one normalized other parameter using a mathematical model.

In further features, a processing module is configured to generate an exponential MBT spark timing by applying an exponential function to the MBT spark timing of the engine, and the estimation module configured to estimate the torque output of the engine further based on the exponential MBT spark timing using the mathematical model.

In further features, a processing module is configured to: generate an exponential MBT spark timing by applying an exponential function to the MBT spark timing of the engine; and generate an exponential of negative MBT spark timing by applying an exponential function to the negative MBT spark timing of the engine, where the estimation module configured to estimate the torque output of the engine further based on the exponential MBT spark timing and the exponential of negative MBT spark timing using the mathematical model.

In further features, an MBT module is configured to generate the MBT spark timing based on an air per cylinder, an inverse APC, an engine speed, an intake cam phaser angle, an exhaust cam phaser angle, an equivalence ratio, and an opening of an EGR valve.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Internal combustion engines combust an air and fuel mixture within cylinders to generate torque. Under some circumstances, an engine control module (ECM) may deactivate one or more cylinders of the engine. The ECM may deactivate one or more cylinders, for example, to decrease fuel consumption when the engine can achieve a torque request using less than all of the cylinders of the engine. The ECM may activate one or more deactivated cylinders, for example, when the torque request increases.

According to the present application, the ECM estimates a torque output of the engine (e.g., a brake torque) using an engine torque model. An input to the engine torque model may include, for example, a sigmoid spark generated by applying a sigmoid (e.g., logistic) function or a sinusoidal transformation to a normalized spark timing. Additionally or alternatively, a maximum braking torque (MBT) spark timing may be determined and input to the engine torque model to estimate the torque output of the engine. Pre-processing of the inputs to the engine torque model improves correlation between model inputs and the estimated torque. The engine torque model can also be inverted to estimate a parameter based on a torque of the engine (e.g., a torque request) and the other inputs to the engine torque model.

Figure 1:
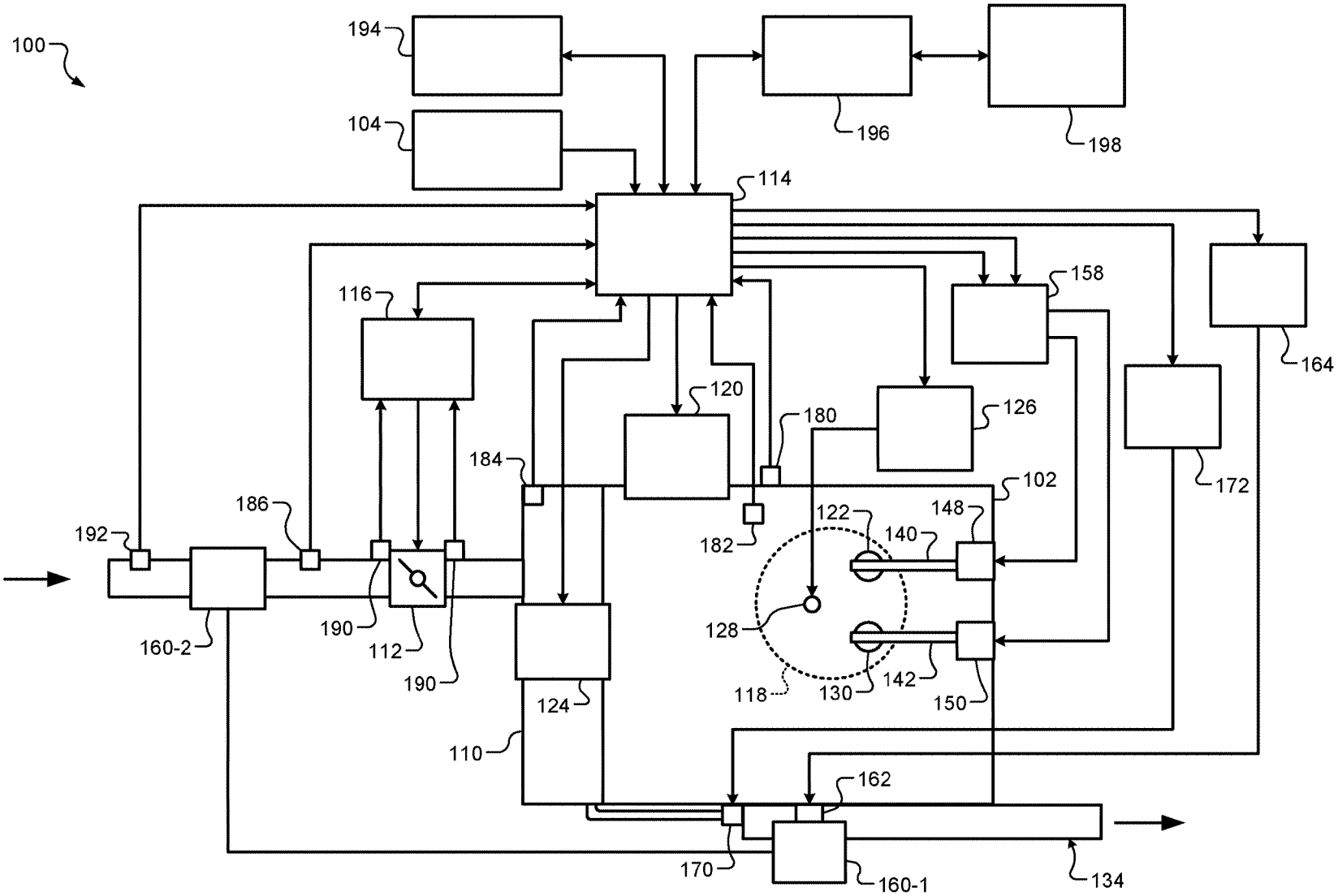
FIG. 1 is a functional block diagram of an example engine system.

Referring now to FIG. 1, a functional block diagram of an example engine system 100 is presented. The engine system 100 includes an engine 102 that combusts an air/fuel mixture to produce drive torque for a vehicle based on driver input from a driver input module 104. Air is drawn into an intake manifold 110 through a throttle valve 112. For example only, the throttle valve 112 may include a butterfly valve having a rotatable blade. An engine control module (ECM) 114 controls a throttle actuator module 116, which regulates opening of the throttle valve 112 to control the amount of air drawn into the intake manifold 110.

Air from the intake manifold 110 is drawn into cylinders of the engine 102. While the engine 102 may include multiple cylinders, for illustration purposes a single representative cylinder 118 is shown. For example only, the engine 102 may include 2, 3, 4, 5, 6, 8, 10, and/or 12 cylinders. The ECM 114 may instruct a cylinder actuator module 120 to selectively deactivate some of the cylinders, which may improve fuel economy under certain engine operating conditions.

The engine 102 may operate using a four-stroke cycle or another suitable combustion cycle. The four strokes of a four-stroke cycle, described below, may be referred to as the intake stroke, the compression stroke, the combustion stroke, and the exhaust stroke. During each revolution of a crankshaft (not shown), two of the four strokes occur within the cylinder 118. Therefore, two crankshaft revolutions are necessary for the cylinder 118 to experience all four of the strokes.

During the intake stroke, air from the intake manifold 110 is drawn into the cylinder 118 through an intake valve 122. The ECM 114 controls a fuel actuator module 124, which regulates fuel injection to achieve a target air/fuel ratio. Fuel may be injected into the intake manifold 110 at a central location or at multiple locations, such as near the intake valve 122 of each of the cylinders. In various implementations (not shown), fuel may be injected directly into the cylinders or into mixing chambers associated with the cylinders. The fuel actuator module 124 may halt injection of fuel to cylinders that are deactivated.

The injected fuel mixes with air and creates an air/fuel mixture in the cylinder 118. During the compression stroke, a piston (not shown) within the cylinder 118 compresses the air/fuel mixture. While not shown, the engine 102 may be a compression-ignition engine, in which case compression within the cylinder 118 ignites the air/fuel mixture. Alternatively, as shown, the engine 102 may be a spark-ignition engine, in which case a spark actuator module 126 energizes a spark plug 128 in the cylinder 118 based on a signal from the ECM 114, which ignites the air/fuel mixture. The timing of the spark may be specified relative to the time when the piston is at its topmost position, referred to as top dead center (TDC).

The spark actuator module 126 may be controlled by a timing signal specifying how far before or after TDC to generate the spark. Because piston position is directly related to crankshaft rotation, operation of the spark actuator module 126 may be synchronized with crankshaft angle. The spark actuator module 126 may halt provision of spark to deactivated cylinders. Generating spark may be referred to as a firing event. The spark actuator module 126 may have the ability to vary the timing of the spark for each firing event. The spark actuator module 126 may vary the spark timing for a next firing event when the spark timing is changed between a last firing event and the next firing event.

During the combustion stroke, the combustion of the air/fuel mixture drives the piston away from TDC, thereby driving the crankshaft. The combustion stroke may be defined as the time between the piston reaching TDC and the time at which the piston reaches bottom dead center (BDC). During the exhaust stroke, the piston begins moving away from BDC and expels the byproducts of combustion through an exhaust valve 130. The byproducts of combustion are exhausted from the vehicle via an exhaust system 134.

The intake valve 122 may be controlled by an intake camshaft 140, while the exhaust valve 130 may be controlled by an exhaust camshaft 142. In various implementations, multiple intake camshafts (including the intake camshaft 140) may control multiple intake valves (including the intake valve 122) for the cylinder 118 and/or may control the intake valves (including the intake valve 122) of multiple banks of cylinders (including the cylinder 118). Similarly, multiple exhaust camshafts (including the exhaust camshaft 142) may control multiple exhaust valves for the cylinder 118 and/or may control exhaust valves (including the exhaust valve 130) for multiple banks of cylinders (including the cylinder 118). The cylinder actuator module 120 may deactivate the cylinder 118 by disabling opening of the intake valve 122 and/or the exhaust valve 130. In various other implementations, the intake valve 122 and/or the exhaust valve 130 may be controlled by devices other than camshafts, such as camless valve actuators.

The time when the intake valve 122 is opened may be varied with respect to piston TDC by an intake cam phaser 148. The time when the exhaust valve 130 is opened may be varied with respect to piston TDC by an exhaust cam phaser 150. A phaser actuator module 158 may control the intake cam phaser 148 and the exhaust cam phaser 150 based on signals from the ECM 114. When implemented, variable valve lift (not shown) may also be controlled by the phaser actuator module 158.

The engine system 100 may include a boost device that provides pressurized air to the intake manifold 110. For example, FIG. 1 shows a turbocharger including a hot turbine 160-1 that is powered by hot exhaust gases flowing through the exhaust system 134. The turbocharger also includes a cold air compressor 160-2 that is driven by the turbine 160-1. The compressor 160-2 compresses air leading into the throttle valve 112. In various implementations, a supercharger (not shown), driven by the crankshaft, may compress air from the throttle valve 112 and deliver the compressed air to the intake manifold 110.

A wastegate 162 may allow exhaust to bypass the turbine 160-1, thereby reducing the boost (the amount of intake air compression) provided by the turbocharger. The ECM 114 may control the turbocharger via a boost actuator module 164. The boost actuator module 164 may modulate the boost of the turbocharger by controlling opening of the wastegate 162. In various implementations, multiple turbochargers may be controlled by the boost actuator module 164. The turbocharger may have variable geometry, which may be controlled by the boost actuator module 164.

An intercooler (not shown) may dissipate some of the heat contained in the compressed air charge, which is generated as the air is compressed. The compressed air charge may also have absorbed heat from components of the exhaust system 134. Although shown separated for purposes of illustration, the turbine 160-1 and the compressor 160-2 may be attached to each other, placing intake air in close proximity to hot exhaust.

The engine system 100 may include an exhaust gas recirculation (EGR) valve 170, which selectively redirects exhaust gas back to the intake manifold 110. The EGR valve 170 may be located upstream of the turbocharger's turbine 160-1. The EGR valve 170 may be controlled by an EGR actuator module 172.

The engine system 100 may measure the rotational speed of the crankshaft in revolutions per minute (RPM) using an RPM sensor 180. The speed of the crankshaft may be referred to as an engine speed. The temperature of the engine coolant may be measured using an engine coolant temperature (ECT) sensor 182. The ECT sensor 182 may be located within the engine 102 or at other locations where the coolant is circulated, such as a radiator (not shown).

The pressure within the intake manifold 110 may be measured using a manifold absolute pressure (MAP) sensor 184. In various implementations, engine vacuum, which is the difference between ambient air pressure and the pressure within the intake manifold 110, may be measured. The mass flow rate of air flowing into the intake manifold 110 may be measured using a mass air flow (MAF) sensor 186. In various implementations, the MAF sensor 186 may be located in a housing that also includes the throttle valve 112.

The throttle actuator module 116 may monitor the position of the throttle valve 112 using one or more throttle position sensors (TPS) 190. The ambient temperature of air being drawn into the engine 102 may be measured using an intake air temperature (IAT) sensor 192. The engine system 100 may also include one or more other sensors. The ECM 114 may use signals from the sensors to make control decisions for the engine system 100.

The ECM 114 may communicate with a transmission control module 194 to coordinate shifting gears in a transmission (not shown). For example, the ECM 114 may reduce engine torque during a gear shift. The ECM 114 may communicate with a hybrid control module 196 to coordinate operation of the engine 102 and an electric motor 198. While the example of one electric motor is provided, the vehicle may include more than one electric motor.

The electric motor 198 may also function as a generator, and may be used to produce electrical energy for use by vehicle electrical systems and/or for storage in a battery. In various implementations, various functions of the ECM 114, the transmission control module 194, and the hybrid control module 196 may be integrated into one or more modules.

Each system that varies an engine parameter may be referred to as an actuator. Each system receives a target actuator value. For example, the throttle actuator module 116 may be referred to as an actuator, and a target throttle opening (e.g., area) may be referred to as the target actuator value. In the example of FIG. 1, the throttle actuator module 116 achieves the target throttle opening by adjusting an angle of the blade of the throttle valve 112.

Similarly, the spark actuator module 126 may be referred to as an actuator, while the corresponding target actuator value may be a target spark timing, for example, relative to piston TDC. Other actuators may include the cylinder actuator module 120, the fuel actuator module 124, the phaser actuator module 158, the boost actuator module 164, and the EGR actuator module 172. For these actuators, the target actuator values may include target number of activated cylinders, target fueling parameters, target intake and exhaust cam phaser angles, target wastegate duty cycle, and target EGR valve opening area, respectively. The ECM 114 may generate the target actuator values to cause the engine 102 to generate a target engine output torque.

Figure 2:
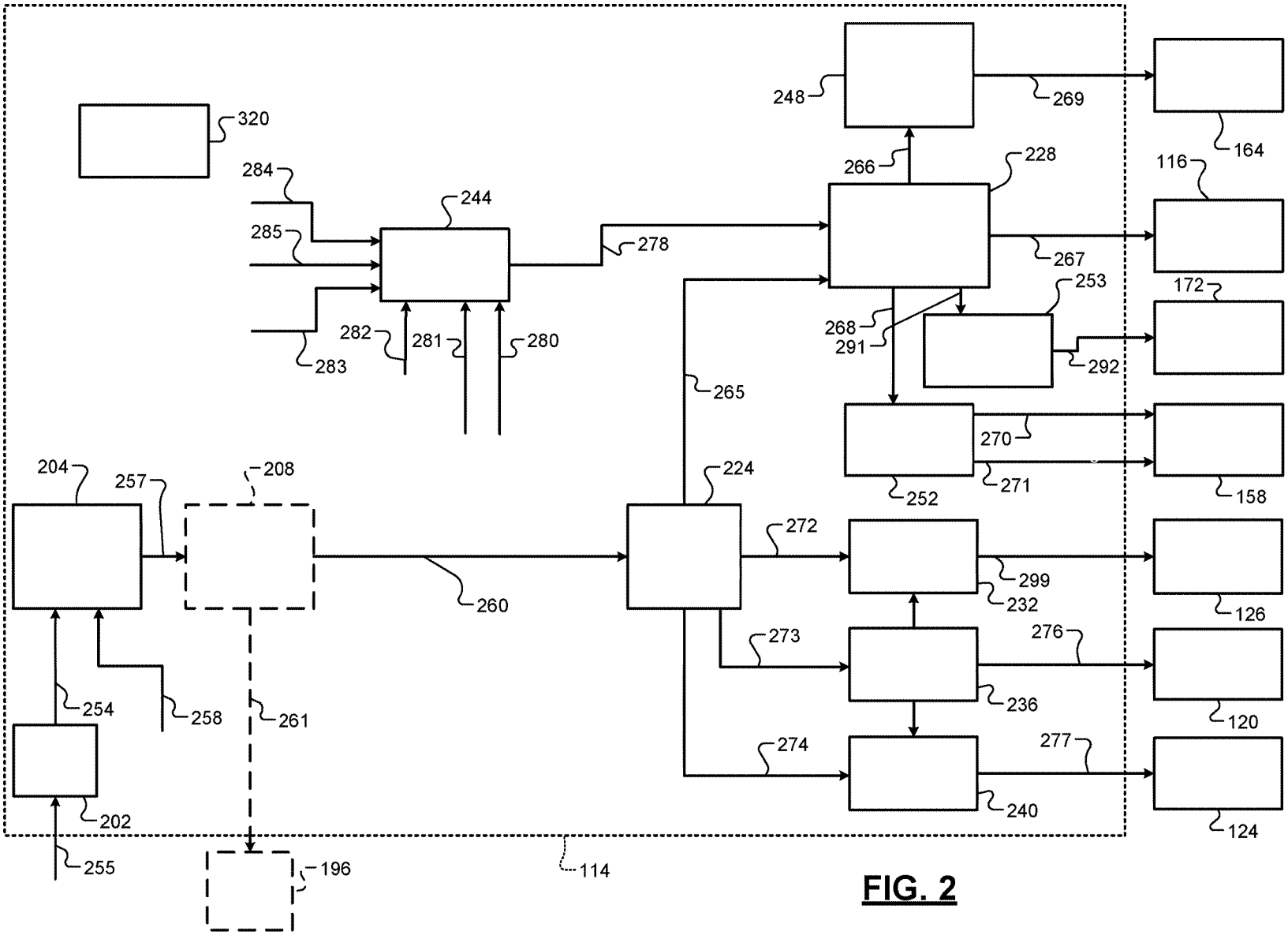
FIG. 2 is a functional block diagram of an example engine control system.

Referring now to FIG. 2, a functional block diagram of an example engine control system is presented. An example implementation of the ECM 114 includes a driver torque module 202 and a torque arbitration module 204. The ECM 114 may include a hybrid optimization module 208. The ECM 114 may include a torque requesting module 224, an air control module 228, a spark control module 232, a cylinder control module 236, and a fuel control module 240. The ECM 114 also includes a torque estimation module 244, a boost control module 248, a phaser control module 252, and an EGR control module 253.

The driver torque module 202 may determine a driver torque request 254 based on a driver input 255 from the driver input module 104. The driver input 255 may be based on or include, for example, a position of an accelerator pedal and a position of a brake pedal. The driver input 255 may also be based on or include a cruise control input, which may be generated by an adaptive cruise control system based on varying vehicle speed to maintain a predetermined following distance. The driver torque module 202 may include one or more mappings of accelerator pedal position to target torque and may determine the driver torque request 254 based on a selected one of the mappings.

The torque arbitration module 204 may arbitrate between the driver torque request 254 and other torque requests 258. The axle torque arbitration module 204 outputs one or more torque requests 257 based on the results of the arbitration between the received torque requests 254 and 258.

The torque arbitration module 204 may output the one or more torque requests 257 to the hybrid optimization module 208. The hybrid optimization module 208 may determine how much torque should be produced by the engine 102 and how much torque should be produced by the electric motor 198. The hybrid optimization module 208 outputs one or more modified engine torque requests 260 and a motor torque request 261. The hybrid control module 196 controls torque output of the electric motor(s) based on (e.g., to achieve) the motor torque request 261. The engine 102 is controlled based on (e.g., to achieve) the one or more modified engine torque requests 260. In various implementations, the hybrid optimization module 208 may be implemented in the hybrid control module 196. In various implementations, the one or more modified engine torque requests 260 may be adjusted based on a torque reserve and/or a torque load. In various implementations, one or more conversions from axle torque (torque at the wheels) to propulsion torque (torque at the crankshaft) may be performed.

The torque requesting module 224 receives the one or more modified engine torque requests 260. The torque requesting module 224 determines how the one or more modified engine torque requests 260 will be achieved by the engine 102. The torque requesting module 224 may be engine type specific. For example, the torque requesting module 224 may be implemented differently or use different control schemes for spark-ignition engines versus compression-ignition engines.

In various implementations, the torque requesting module 224 may generate an air torque request 265 based on the one or more modified engine torque requests 260. Target actuator values for airflow controlling actuators may be determined based on the air torque request 265. For example only, the air control module 228 may determine a target manifold absolute pressure (MAP) 266, a target throttle opening (e.g., area) 267, a target air per cylinder (APC) 268, and a target APC (APC) 291 based on the air torque request 265. The air control module 228 may determine the targets 266-268 and 291 using one or more equations and/or lookup tables that relate air torque requests to values of the targets 266-268 and 291.

The boost control module 248 may determine a target duty cycle 269 for the wastegate 162 based on the target MAP 266. While the target duty cycle 269 will be discussed, the boost control module 248 may determine another suitable value for controlling the wastegate 162. The phaser control module 252 may determine target intake and exhaust cam phaser angles 270 and 271 based on the target APC 268. The EGR control module 253 determines a target EGR opening 292 based on the target APC 291. The targets 269-271 and 292 may be determined by the respective modules using one or more equations and/or lookup tables that relate the respective inputs to the respective targets 269-271 and 292.

The torque requesting module 224 may also generate a spark torque request 272, a cylinder shut-off torque request 273, and a fuel torque request 274. The spark control module 232 may determine how much to retard the spark timing (which reduces engine output torque) from a maximum brake torque (MBT) spark timing based on the spark torque request 272. For example only, a torque model, such as the torque model discussed below, may be inverted to solve for a target spark timing 299. The MBT spark timing may refer to an estimated spark timing used to generate a maximum brake torque for predetermined operating conditions. The MBT spark timing is discussed further below.

The cylinder shut-off torque request 273 may be used by the cylinder control module 236 to determine a target number of cylinders to deactivate 276. The cylinder control module 236 may also instruct the fuel control module 240 to stop providing fuel for deactivated cylinders and may instruct the spark control module 232 to stop providing spark for deactivated cylinders. The spark control module 232 may stop providing spark to a cylinder once an fuel/air mixture that is already present in the cylinder has been combusted.

The fuel control module 240 may control fuel injection into a next cylinder in the predetermined firing order based on the fuel torque request 274. More specifically, the fuel control module 240 may generate target fueling parameters 277 based on the fuel torque request 274. The target fueling parameters 277 may include, for example, a target equivalence ratio (EQR), a target mass of fuel, a target start of injection (SOI) timing, a target end of injection (EOI) timing, and a target number of fuel injections.

The air control module 228 generates the target MAP 266, the target throttle opening 267, the target APC 268, and the target APC 291 based on the estimated torque 278. The estimated torque 278 may be an estimated value of the present engine torque output (i.e., torque output of the engine 102) and is determined as described below.

The air control module 228 may output the target throttle opening 267 to the throttle actuator module 116. The throttle actuator module 116 regulates the throttle valve 112 to produce the target throttle opening 267. The air control module 228 outputs the target MAP 266 to the boost control module 248. The boost control module 248 controls the wastegate 162 based on (e.g., to achieve) the target MAP 266. The air control module 228 outputs the target APC 268 to the phaser control module 252. Based on the target APC 268, the phaser control module 252 may control positions of the intake and/or exhaust cam phasers 148 and 150.

As discussed further below, the torque estimation module 244 uses a torque model to determine the estimated torque 278 based on a present engine speed (RPM) 280, a present EQR 281, a present air per cylinder (APC) 282, a present spark timing 283, a present intake cam phaser angle 284, and a present exhaust cam phaser angle 285. The torque estimation module 244 may additionally determine the estimated torque 278 based on a present SOI timing 308 of fueling and a present EOI timing 312 of fueling. In various implementations, the torque estimation module 244 may additionally determine the estimated torque 278 based on a present MBT spark timing 316.

Figure 3:
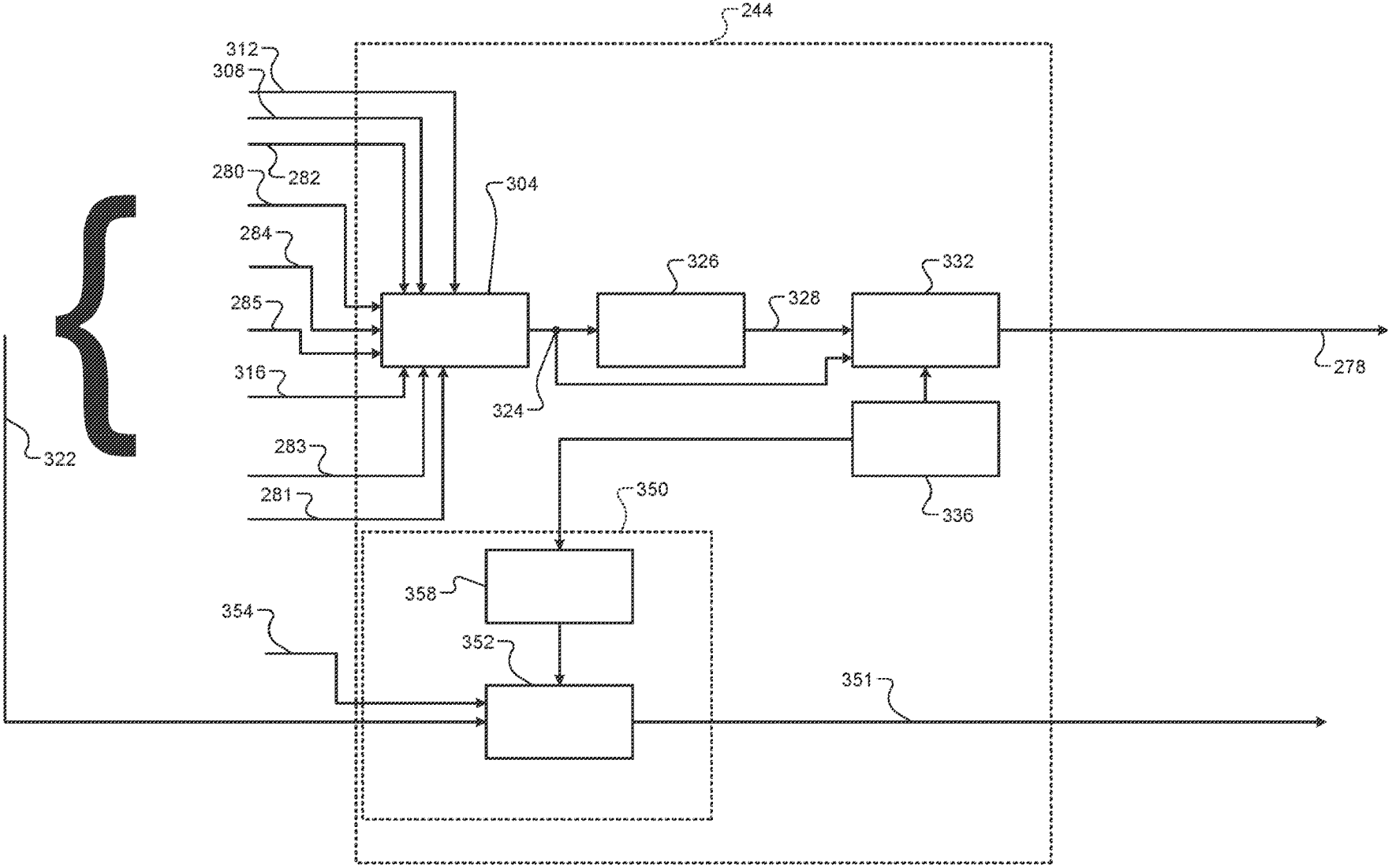
FIG. 3 is a functional block diagram of a torque estimation module.

FIG. 3 is a functional block diagram of an example implementation of the torque estimation module 244. A normalization module 304 receives the APC 282, the engine speed 280, the intake cam phaser angle 284, the exhaust cam phaser angle 285, the spark timing 283, and the EQR 281. The normalization module 304 may also receive a present start of injection (SOI) timing 308 of fueling, and a present end of injection (EOI) timing 312 of fueling. The normalization module 304 may also receive a present MBT spark timing 316.

An MBT module 320 (FIG. 2) may determine the MBT spark timing 316. The MBT spark timing 316 may be the spark timing used to generate the MBT for the predetermined operating conditions. Using combustion measurements and sweeping the spark timing for a fixed engine speed, APC, intake cam phaser angle, and exhaust cam phaser angle, the spark closest to MBT is that which yields a CA50 (crankshaft angle after TDC at which 50 percent of injected fuel is consumed/combusted) closest to 8.5 degrees. The MBT module 320 may determine the MBT spark timing 316 using the equation:

$$MBT=C_Spark+(C_CA50-8.5)+offset,$$

where MBT is the MBT spark timing 316, C_Spark and C_CA50 are the spark timing and CA50 values in the spark timing sweep where CA50 is closest to 8.5 degrees. Offset is a predetermined value and may be calibrated based on compensating for operating conditions where the MBT spark timing does not coincide with a CA50 value of 8.5 degrees. As an alternative, the MBT module 320 may determine the MBT spark timing 316 based on APC, an inverse APC, the engine speed, the intake and exhaust cam phaser angles, the equivalence ratio, and an opening of the EGR valve. The determination may be made using one or more equations (e.g., a neural network or another suitable type of model) and/or one or more lookup tables The MBT spark timing 316 may have an inverse relationship with the APC 282.

Collectively, the APC 282, the engine speed 280, the intake cam phaser angle 284, the exhaust cam phaser angle 285, the spark timing 283, and the EQR 281, the SOI timing 308 (if included), the EOI timing 312 (if included), and the MBT spark timing 316 will be referred to as input parameters 322. The normalization module 304 normalizes each of the input parameters 322 to within a predetermined range. The predetermined range may be, for example, 0 to 1, inclusive, −1 to +1, inclusive, or another suitable range. The normalization module 304 normalizes a given one of the input parameters 322 using interpolation between predetermined minimum and maximum values of that input parameter. For example, when the input parameter is equal to the predetermined minimum value, the normalization module 304 may set the normalized parameter to the lower limit value of the predetermined range (e.g., 0 or −1). When the input parameter is equal to the predetermined maximum value, the normalization module 304 may set the normalized parameter to the upper limit value of the predetermined range (e.g., 1). When the input parameter is between the predetermined minimum and maximum values, the normalization module 304 may set the normalized parameter between the upper and lower limit values of the predetermined range via interpolation, such as linear interpolation. The normalization module 304 does this for each of the input parameters 322 to produce normalized parameters 324. The normalized parameters 324 include a normalized APC, a normalized engine speed, a normalized intake cam phaser angle, a normalized exhaust cam phaser angle, a normalized spark timing, a normalized EQR, a normalized SOI timing (if included), a normalized EOI timing (if included), and a normalized MBT spark timing.

A processing module 326 performs one or more signal processing functions on one or more of the normalized parameters 324 to produce one or more processed parameters 328, respectively. For example, the processing module 326 may apply a sigmoid function to one or more of the normalized parameters 324 to produce one or more sigmoidal parameters, respectively. For example, the processing module 326 may apply a sigmoid function to the normalized spark timing to produce a sigmoidal spark timing. The sigmoid function may be, for example, a logistic function or another suitable type of sigmoid function. The processing module 326 may apply an exponential function to one or more of the normalized parameters 324 to produce one or more exponential parameters, respectively. For example, the processing module 326 may apply the exponential function to the normalized intake cam phaser angle, the normalized exhaust cam phaser angle, the normalized engine speed, the normalized MBT spark timing, the normalized SOI timing, and the normalized EOI timing to produce an exponential intake cam phaser angle, an exponential exhaust cam phaser angle, an exponential engine speed, an exponential MBT spark timing, an exponential normalized SOI timing, and an exponential normalized EOI timing, respectively. The processing module 326 may apply a negative exponential function to one or more of the normalized parameters 324 to produce one or more negative exponential parameters, respectively. For example, the processing module 326 may apply the negative exponential function to the normalized engine speed, the normalized MBT spark timing, the normalized SOI timing, and the normalized EOI timing to produce a negative exponential engine speed, a negative exponential MBT spark timing, a negative exponential SOI timing, and a negative exponential EOI, respectively. The processing module 326 may apply a sinusoidal function to one or more of the normalized parameters 324 to produce one or more sinusoidal parameters, respectively. For example, the processing module 326 may apply the sinusoidal function to the normalized intake cam phaser angle, the normalized exhaust cam phaser angle, the normalized engine speed, the normalized MBT spark timing, the normalized SOI timing, and the normalized EOI timing to produce a sinusoidal intake cam phaser angle, a sinusoidal exhaust cam phaser angle, a sinusoidal engine speed, a sinusoidal MBT spark timing, a sinusoidal normalized SOI timing, and a sinusoidal normalized EOI timing, respectively.

The exponential function may be described as $y=e^{x}$, where y is the exponential parameter, e is the exponent function, and x is the normalized parameter. The negative exponential function may be described as $y=e^{-x}$ where y is the exponential parameter, e is the exponent function, and x is the normalized parameter. The sigmoid function may be described as $y=1/(1+e^{-mx})$, where y is the exponential parameter, e is the exponent function, m is a predetermined multiplier value, and x is the normalized parameter. m is may be a calibrated value.

An estimation module 332 determines the estimated torque 278 based on one or more of the input parameters 322, one or more of the normalized parameters 324, and/or one or more of the processed parameters 328 using a mathematical model 336. For example, the estimation module 332 may determine the estimated torque 278 based on the following inputs (x), x=[the normalized intake cam phaser angle, the exponential intake cam phaser angle, the normalized exhaust cam phaser angle, the exponential exhaust cam phaser angle, the sigmoidal spark timing, the normalized APC, the normalized engine speed, the exponential engine speed, the negative exponential engine speed, the normalized EQR, the normalized MBT spark timing, the exponential MBT spark timing, the negative exponential spark timing]. The model may be, for example, a second order or a third order polynomial for each of the inputs (x). An example of a third order polynomial is:

$$f(x_1,x_2,x_3)=ax_1^3+bx_2^3+cz^3+dx_1^2+ex_1^2x^2+fx_1^2z+gx_2^2+hx_2^2x_1+ix_2^2x^3+jx_3^2+kx_3^2x_1+lz^2x_2+mx_1x_2+nx_1x_3+ox_2x_3+px_1+qx_2+rx_3+s,$$

where a-s are predetermined values, and x1-x3 are ones of the input parameters. Use of the above third order polynomial equation may result in the model 336 having 559 terms. One or more methods may be used to eliminate any underperforming terms in the polynomial equation, such as via Lasso regression or in another suitable manner.

One or more actuators can be controlled based on the estimated torque 278. For example, the air control module 228 may control opening of the wastegate 162 based on the estimated torque 278. The air control module 228 may control opening of the throttle valve 112 based on the estimated torque 278. The air control module 228 may control opening of the EGR valve 170 based on the estimated torque 278. The air control module 228 may control actuation of the intake and/or exhaust cam phasers 148 and 150 based on the estimated torque 278. The spark control module 232 may control spark timing based on the estimated torque 278. The fuel control module 240 may control fuel injection based on the estimated torque 278. The cylinder control module 236 may control activation/deactivation of cylinders based on the estimated torque 278. The inversion above helps achieve the target air and spark values from the torque request, and the forward estimation provides feedback to assess whether the torque request is being achieved.

Figure 4:
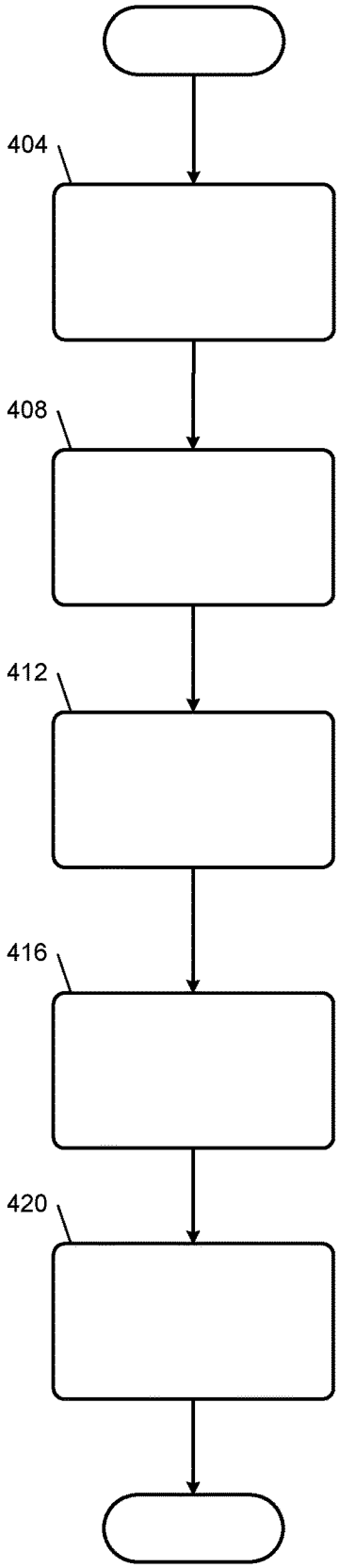
FIG. 4 is a flowchart depicting an example method of estimating torque output of the engine and controlling engine actuators.

FIG. 4 is a flowchart depicting an example method of estimating torque output of the engine 102 and controlling engine actuators. Control begins with 404 where the normalization module 304 receives the input parameters 322. At 408, the normalization module 304 normalizes the input parameters 322 to produce the normalized parameters 324, respectively.

At 412, the processing module 326 receives the normalized parameters 324 and performs signal processing on one or more of the normalized parameters 324 to produce the one or more processed parameters 328, respectively. At 416, the estimation module 332 determines the estimated torque 278 based on the normalized parameters and the one or more processed parameters 328 using the model 336, as discussed above. For example, the estimation module 332 may determine the estimated torque 278 using the model 336 based on the normalized intake cam phaser angle, the exponential intake cam phaser angle, the normalized exhaust cam phaser angle, the exponential exhaust cam phaser angle, the sigmoidal spark timing, the normalized APC, the normalized engine speed, the exponential engine speed, the negative exponential engine speed, the normalized EQR, the normalized MBT spark timing, the exponential MBT spark timing, and the negative exponential spark timing.

At 420, one or more actuators are adjusted based on the estimated torque 278. For example, the air control module 228 may adjust opening of the wastegate 162 based on the estimated torque 278. The air control module 228 may adjust opening of the throttle valve 112 based on the estimated torque 278. The air control module 228 may adjust opening of the EGR valve 170 based on the estimated torque 278. The air control module 228 may adjust positioning of the intake and/or exhaust cam phasers 148 and 150 based on the estimated torque 278. The spark control module 232 may adjust spark timing based on the estimated torque 278. The fuel control module 240 may adjust fuel injection based on the estimated torque 278. The cylinder control module 236 may adjust activation/deactivation of cylinders based on the estimated torque 278. While control is shown as ending after 420, control may return to 404, and 404-420 may be started every predetermined period.

Referring back to FIG. 3, a parameter estimation module 350 may estimate one of the input parameters 322. More specifically, a parameter module 352 may estimate one parameter 351 of the input parameters 322 based on a torque 354 and other ones of the input parameters 322 by inverting the model 336. An inversion module 358 may invert the model 336 for the determination of the one of the input parameters 322. The torque 354 may be, for example, one of the torque requests discussed above, a desired torque, a target torque, etc.

When a torque is requested and all inputs except for one are specified, the model 336 can be used to solve for the one unspecified input. The first, second, third order and constant terms in the model 336 can be grouped to form the equation:

$$ax^3+bx^2+cx+d=0.$$

Solving a third order equation can result in 1 or 3 real roots. First the general form of the cubic may be modified to remove the leading coefficient (a). $x^3+c_1x^2+c_2x+c_3=0$, where $c_1=b/a$, $c_2=c/a$ and $c_3=d/a$. Then the discriminant (M) can be calculated. as follows:

$$Q=(c_1^2-3c_2)/9,$$

$$R=(2c_1^3-9c_1c_2+27c_3)/54,$$

$$M=R^2-Q^3$$

If M<0, there are three roots, and if M>0 there is only one root. If 3 real inputs are present, the inversion module 358 selects which of the 3 roots to use as an engine control target.

For example, the inversion module 358 may select a root by creating a supplemental forward regressor for the variable that the model 336 is being inverted to find (the one unspecified input). For example, a forward APC regressor can be used to estimate a target APC given a set of intake and exhaust cam phaser angles, an engine speed, a spark timing, and a torque request. Additionally, the inversion module 358 may create a regressor using the characteristics of the cubic equation being solved, including the coefficients (a, b, c, d), the inflection and turning points. In the 3-root case, the closest root to the output of the forward regressor may be chosen as a control target.

The inversion module 358 may rule out infeasible roots based on predetermined control limits. For example, when solving for spark timing, any root found must be less than the MBT spark timing. The MBT spark can be determined as described above or by using the first and second derivative of the univariate third order polynomial with respect to spark timing. Solving the first derivative where the rate of change is equal to zero may yield spark timing values that would cause the minimum and maximum torque (turning points).

$$3ax^2+2bx+c=0$$

After solving the quadratic equation, the second derivative can be used to distinguish between the roots.

$$d^2f/dx=6ax+2b$$

Solving for x with the second derivative equal to zero yields the x coordinate of the inflection point (x=−b/3a). If the second derivative for a root is greater than zero, that is the spark advance at which min torque is generated. If the second derivative for a root is less than zero, that is the spark at which the MBT is generated.

To avoid the complexity associated with the 3-root example, the inversion module 358 may enforce a regression constraint that will only allow the cubic to have a single root solution. The inversion module 358 may constrain coefficients such that M>0, so that only a single root solution is possible. Alternatively, the inversion module 358 may eliminate the third order term for the input that the model 336 is being inverted to find, so that a quadratic formula can be used to find up to 2 real roots. The inversion module 358 may determine which of the 2 roots to select.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

What is claimed is:

1. An engine control system, comprising:

a normalization module configured to normalize, to within a predetermined range of values, a spark timing of an engine and at least one other parameter of the engine, thereby producing a normalized spark timing and at least one normalized other parameter, respectively;

a processing module configured to generate a sigmoidal spark timing by applying, to the normalized spark timing, one of (a) a sigmoidal function and a sinusoidal function; and an estimation module configured to estimate a torque output of the engine based on the normalized spark timing and the at least one normalized other parameter using a mathematical model.

2. The engine control system of claim 1 further comprising an actuator module configured to adjust an engine actuator based on the estimated torque output of the engine.

3. The engine control system of claim 1 wherein the at least one other parameter of the engine includes an engine speed.

4. The engine control system of claim 1 wherein the at least one other parameter of the engine includes a mass of air per cylinder (APC) of the engine.

5. The engine control system of claim 1 wherein the at least one other parameter of the engine includes an intake cam phaser angle.

6. The engine control system of claim 1 wherein the at least one other parameter of the engine includes an exhaust cam phaser angle.

7. The engine control system of claim 1 wherein the at least one other parameter of the engine includes an equivalence ratio (EQR) of the engine.

8. The engine control system of claim 1 wherein the at least one other parameter of the engine includes a maximum braking torque (MBT) spark timing of the engine.

9. The engine control system of claim 1 wherein the at least one other parameter of the engine includes:

an engine speed;

a mass of air per cylinder (APO) of the engine;

an intake cam phaser angle;

an exhaust cam phaser angle;

an equivalence ratio (EQR) of the engine; and a maximum braking torque (MBT) spark timing of the engine.

10. The engine control system of claim 1 wherein the sigmoid function includes a logistic function.

11. The engine control system of claim 1 wherein the at least one other parameter of the engine includes a timing of a start of fuel injection of the engine.

12. The engine control system of claim 1 wherein the at least one other parameter of the engine includes a timing of an end of fuel injection of the engine.

13. The engine control system of claim 1 wherein the processing module is further configured to generate an exponential engine speed by applying an exponential function to an engine speed, and wherein the estimation module configured to estimate the torque output of the engine further based on the exponential engine speed using the mathematical model.

14. The engine control system of claim 1 wherein the processing module is further configured to generate an exponential of negative engine speed by applying an exponential function to a negative engine speed, and wherein the estimation module configured to estimate the torque output of the engine further based on the exponential of negative engine speed using the mathematical model.

15. The engine control system of claim 1 wherein the processing module is further configured to generate an exponential maximum braking torque (MBT) spark timing by applying an exponential function to an MBT spark timing of the engine, and wherein the estimation module configured to estimate the torque output of the engine further based on the exponential MBT spark timing using the mathematical model.

16. The engine control system of claim 1 wherein the processing module is further configured to generate an exponential of negative maximum braking torque (MBT) spark timing by applying an exponential function to a negative MBT spark timing of the engine, and wherein the estimation module configured to estimate the torque output of the engine further based on the exponential of negative MBT spark timing using the mathematical model.

17. An engine control system, comprising:

a normalization module configured to normalize, to within a predetermined range of values, a maximum braking torque (MBT) spark timing of an engine and at least one other parameter of the engine, thereby producing a normalized MBT spark timing and at least one normalized other parameter, respectively; and an estimation module configured to estimate a torque output of the engine based on the normalized MBT spark timing and the at least one normalized other parameter using a mathematical model.

18. The engine control system of claim 17 further comprising a processing module configured to generate an exponential MBT spark timing by applying an exponential function to the MBT spark timing of the engine, and wherein the estimation module configured to estimate the torque output of the engine further based on the exponential MBT spark timing using the mathematical model.

19. The engine control system of claim 17 further comprising a processing module configured to:

generate an exponential MBT spark timing by applying an exponential function to the MBT spark timing of the engine; and generate an exponential of negative MBT spark timing by applying an exponential function to the negative MBT spark timing of the engine, wherein the estimation module configured to estimate the torque output of the engine further based on the exponential MBT spark timing and the exponential of negative MBT spark timing using the mathematical model.

20. The engine control system of claim 17 further comprising an MBT module configured to generate the MBT spark timing based on an air per cylinder, an inverse APC, an engine speed, an intake cam phaser angle, an exhaust cam phaser angle, an equivalence ratio, and an opening of an EGR valve.

* * * * *